US008795106B2

(12) United States Patent
Guertin

(10) Patent No.: US 8,795,106 B2
(45) Date of Patent: Aug. 5, 2014

(54) SPORTS SAFETY PADDING

(75) Inventor: Chris Guertin, Minneapolis, MN (US)

(73) Assignee: Sport Resource Group, Inc., Minneapolis, MN (US)

( * ) Notice: Subject to any disclaimer, the term of this patent is extended or adjusted under 35 U.S.C. 154(b) by 257 days.

(21) Appl. No.: 13/234,700

(22) Filed: Sep. 16, 2011

(65) Prior Publication Data

US 2012/0060265 A1 Mar. 15, 2012

Related U.S. Application Data

(63) Continuation-in-part of application No. 13/092,663, filed on Apr. 22, 2011, and a continuation-in-part of application No. 29/398,402, filed on Jul. 29, 2011, now Pat. No. Des. 689,205.

(60) Provisional application No. 61/374,094, filed on Aug. 16, 2010.

(51) Int. Cl.
*A63B 67/00* (2006.01)

(52) U.S. Cl.
CPC ..... *A63B 67/00* (2013.01)
USPC ..... 473/471

(58) Field of Classification Search
USPC ..... 473/470, 471, 472; 160/124; 198/841; 267/140; 29/428; 428/41.7, 58, 61; 472/90; 49/470, 490.1, 496.1; 52/173.2, 211; 62/66; D6/601
See application file for complete search history.

(56) References Cited

U.S. PATENT DOCUMENTS

| | | | | |
|---|---|---|---|---|
| 6,357,187 | B1 * | 3/2002 | Haldeman | 52/211 |
| D689,205 | S * | 9/2013 | Guertin | D25/121 |
| 2012/0036698 | A1 * | 2/2012 | Guertin | 29/428 |
| 2012/0060265 | A1 * | 3/2012 | Guertin | 2/411 |

OTHER PUBLICATIONS

Webpage download, Athlectia catalog, 2004, web.archive.org/web/20050228233254/http://athletica.com/index2.asp, 5 pages.*
Webpage download, Bumblebee Edge Guard, 2010-2013, web.archive.org/web/20100709024008/http://www.littlewhiz.com/pd-bumble-bee-edge-cushion-foam.cfm, 5 pages.*
Athletica product brochure, p. 21, date unknown.

* cited by examiner

*Primary Examiner* — Gene Kim
*Assistant Examiner* — M Chambers
(74) *Attorney, Agent, or Firm* — Bridget M. Hayden; Dorsey & Whitney LLP

(57) ABSTRACT

An energy absorbing termination post padding for hockey rinks includes energy absorbing foam pads configured to absorb impacts from sports play such as hockey. Energy absorbing foam panels may include a rigid foam alone or in combination with a relatively softer foam or impact layer.

12 Claims, 15 Drawing Sheets

SPORTS SAFETY PADDING

CROSS REFERENCE TO RELATED APPLICATIONS

This application is a continuation-in-part of U.S. Application Serial No. 13/092,663, filed Apr. 22, 2011, which claims the benefit under 35 U.S.C. §119(e) to U.S. Provisional Application Ser. No. 61/374,094, filed Aug. 16, 2010, the contents of each of which are herein incorporated by reference in their entireties. This application also claims the benefit of priority under 35 U.S.C. 120 as a continuation-in-part of U.S. Design application Ser. No. 29/398,402, filed Jul. 29, 2011, now issued as U.S. Design Pat. No. D689,205 on Sep. 3, 2013, the contents of which is herein incorporated by reference in its entirety.

FIELD OF THE INVENTION

The present disclosure relates to sports equipment. The present disclosure further relates to sports safety equipment. More particularly, the present disclosure relates to safety padding for reducing sports related injuries.

BACKGROUND OF THE INVENTION

Sporting events such as hockey, basketball, baseball, football and soccer pose serious risks of injury for participant athletes. These injuries can be the result of contact between the athletes themselves, contact between the athlete and the ball or puck, and contact between the athlete and the environment. Contact between an athlete and the environment can be the result of contact with the playing surface, such as ice or the ground, or contact with other objects in, or near the playing surface. Examples of sporting environmental injury risks includes contact with dasher boards or the glass in hockey, contact with basketball poles and scoring tables in basketball, contact with field goal posts in football, and any other situation in which an object in, or near the playing field is susceptible to contact as a result of players in, or leaving the field of play. Contact with these environmental objects presents a serious risk of injury. This is often due to the relatively fixed and stationary aspect of these objects which can result in the athlete absorbing most of the force of the collision.

Hockey in particular poses unique injury risks to participants. In particular, players employ a common technique called "body checking," whereby a player uses his or her body to force the body of the opposing player into the hockey dasher boards or the hockey glass. This technique poses a serious risk of broken bones, torn or strained ligaments, contusions, and concussions as the player contacts the environmental object—i.e. the dasherboards, or glass. Concussions in particular represent a serious threat to hockey players, which can often cause long-term and lasting side effects even years after the initial injury. Contact with environmental injury risks can often contribute to, or cause concussions as the relatively immobile nature of these risks allows for little, if any, shock absorption, and thus the energy of the impact is entirely felt by the athlete.

Proper design of playing surfaces can mitigate the risks posed by environmental injury risks. As an example, the ledger where hockey glass meets hockey dasher boards is an environmental injury risk that has been mitigated some in recent years by the introduction of more yielding materials. Despite these design changes, environmental hazards still exist in hockey. One existing hazard is a glass termination, formed where the glass turns away from the rink to enclose the back, but not the front of the player boxes. Each piece of glass at the corner is connected at this outside corner by a termination post.

The padding covering glass termination hazards oftentimes is inadequate to effectively absorb the impact of the athletes as a result of a collision and can leave the athlete absorbing significant amounts of energy and leading to injury. If padding is provided at all on these terminations, it is usually composed of one layer of thin, and easily compressed soft foam that is wrapped in vinyl. The foam easily compresses upon impact and does little to protect an athlete from injury. Moreover, the foam is simply a flat and square sheet of thin foam, that when installed, is traditionally bent around the corner of the glass termination post, further compressing the already thin foam. This foam is typically an infirm, open cell polyurethane with indent force deflection at 25% of 27-33 lbs measured by ASTM D-3574-01 testing. Indent force deflection is defined as the amount of force, in pounds, required to indent a fifty square inch, round indentor foot into a predefined foam specimen a certain percentage of the specimen's total thickness. A foam rated for shock absorbency generally has an indent force deflection at 25% of 45 lbs and higher. Thus foam that is rated at 27-33 lbs is generally inadequate for safely protecting athletes.

Thus, there exists a need in the art for improved sports safety padding. In particular, improved energy absorbing termination padding for hockey rinks.

BRIEF SUMMARY OF THE INVENTION

In one embodiment, an energy absorbing termination post padding for hockey rinks comprises a first energy absorbing panel which comprises an impact layer comprising a first foam; and a secondary impact layer comprising a second foam that is more rigid than the first foam of the impact layer; and a second energy absorbing panel arranged on an end of the first energy absorbing panel.

In another embodiment, an energy absorbing termination post padding for hockey rinks includes a corner shaped pad with a first side and a second side formed of a compressible foam configured to absorb impact forces. A cover receives and forms around the corner shaped foam. An attachment means attaches the cover to a termination post of the hockey rink.

In another embodiment, a method of preventing hockey injuries comprises placing over a termination post in a hockey rink, a safety padding. The safety padding includes a corner shaped foam with a first side and a second side. The corner shaped foam is formed of a compressible foam configured to absorb impact forces.

While multiple embodiments are disclosed, still other embodiments of the present disclosure will become apparent to those skilled in the art from the following detailed description, which shows and describes illustrative embodiments of the disclosure. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the embodiments will be better understood from the following description taken in conjunction with the accompanying Figures, in which:

DETAILED DESCRIPTION

The present disclosure relates to novel and advantageous sports equipment. Particularly, the present disclosure relates to novel and advantageous sports safety equipment. More particularly, the present disclosure relates to improved safety padding for reducing sports related injuries from athlete contact with hard surfaces. This safety padding can be placed over any obstruction or other object in a playing surface where contact with athletes is likely and provides protection to athletes who contact these obstructions while at the same time, does not interfere with game play. The present disclosure also relates to an improved energy absorbing termination post padding.

Figure 1:
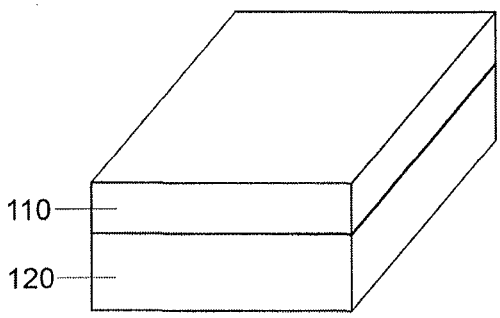
FIG. 1 is a perspective view of the safety foam according to one embodiment.

In one embodiment the safety padding can be a multiple layer pad that can be placed over objects to prevent injury in case of impact. The multiple layer pad can include one or more layers of padding or foam. Turning now to FIG. 1, in one embodiment, the safety padding can include two layers. The first layer is an impact layer 110, and the second layer is a secondary impact layer 120. In other embodiments additional layers are possible (see FIG. 2A). The multiple layer pad can also include one layer of padding or foam (see FIG. 2B).

In one embodiment, the impact layer 110 can be designed to disperse the energy of an athlete impact, but spring back to its original shape easily. This layer can be a shock absorbing layer that decelerates the athlete and rapidly dissipates the energy of the impact lessening the chance for injury. In some embodiments, this layer can be a first type of foam that can have an indent force deflection at 25% of around 40 lbs or more, as measured by ASTM D-3574-01 or similar test, offering a stiff, yet flexible foam.

In some embodiments, the first type of foam of impact layer 110 can allow for displacement of air into and out of the foam, thus enabling the foam to absorb and disperse the energy of the impacting athlete, yet rebound to its original shape easier as air is expelled and then reabsorbed by the foam. In some embodiments, the first type of foam can be an open cell foam. In particular embodiments, the first type of foam of impact layer 110 can be a flexible polyurethane foam, or can be a visco-elastic polyurethane—i.e. "memory foam." One example embodiment can use 7700GY foam available from Amcon™, 5360 Main St. NE Minneapolis, Minn. 55421. The 7700GY foam has an indent force deflection at 25% of 63-77 lbs, with a density of 1.7-1.9 lbs/ft3.

In one embodiment, the secondary impact layer 120 can be positioned in contact with the obstruction or object to which padding is desired and can form a secondary impact layer that absorbs energy from the athlete if the athlete manages to hit the obstruction hard enough to substantially compress the impact layer 110. The secondary impact layer 120 can be made of a second, more rigid type of foam than the first type of foam of impact layer 110 with a compressive strength that is greater than impact layer 110. The secondary impact layer can thus serve to cushion exceedingly hard blows where softer foams are totally compressed and indeed cushion hard blows where impact layer 110 is compressed.

In one embodiment, the secondary impact layer 120 can be a second, more rigid and inflexible type of foam than the impact layer 110. The secondary impact layer 120 can contain foam that has a compressive strength at 25% of around 7 psi or greater with a vertical compressive strength of around 14 psi at 50% as measured by ASTM D-3575-93 Suffix D or other similar test. Alternatively, the secondary impact layer 120 could also be foam that has an indent force deflection at 25% of around 100 lbs or higher as measured by ASTM D-3574-01 or similar test. This is a fairly stiff type of foam, stiffer than the impact layer 110. While this layer may not bounce back to its original shape as readily as the impact layer 120, its purpose is to deform in the event an athlete hits the safety foam with a hard enough impact to fully compress impact layer 110, thus dispersing any remaining energy of the impact that would otherwise be borne by the athlete once the impact layer 110 is fully compressed.

The secondary impact layer 120 can be a closed cell foam such as extruded or expanded polystyrene, including foams formed from pre-expanded beads, polyethylene, expanded polyethylene, extruded polyethylene, polyisocyanurate, expanded polypropylene, expanded polyurethane, or any other foam that has greater rigidity that the impact layer 110. In one embodiment, the foam of secondary impact layer 120 can be POLYFLX10 foam made from expanded polyethylene beads and available from Amcon™, 5360 Main St. NE Minneapolis, Minn. 55421. POLYFLX10 foam can have a density of 1.0 lbs/ft3 with a compressive strength of 7.8 psi at 25%. In another embodiment, the foam may be 9900 foam available from Amcon™, 5360 Main St. NE Minneapolis, Minn. 55421. The foam has an indent force deflection at 25% of 125-145 lbs, with a density of 2.4-2.6 lbs/ft3.

Secondary impact layer 120 can also be an open celled foam. In one embodiment secondary impact layer 120 can be a polyurethane foam. In one embodiment, the secondary impact layer 120 can be ETHER PU 9900 polyurethane foam available from Amcon™, 5360 Main St. NE Minneapolis, Minn. 55421. ETHER PU 990 foam can have an indent force deflection of 125-145 lbs at 25%.

In some embodiments, the impact layer 110 first decelerates the athlete until it is fully compressed. The foam of the impact layer, being softer, distributes the impact on the athlete across a greater surface area, thus minimizing injury and slowing acceleration. On harder impacts, impact layer 110 may become fully compressed. In this scenario, secondary impact layer 120, which is not as compressive as impact layer 110 takes over distributing the force of the impact on the athlete to prevent injury. Thus impact layer 110 and secondary impact layer 120 work in cooperation to prevent injury over a range of impact speeds.

In other embodiments, either the impact layer 110 or the secondary impact layer 120 or both can be a flexible bladder that is filled with air, liquid, gel, or other fluid or gas. In these embodiments, the bladder of the impact layer 110 can be designed so as to have similar performance properties as the foam embodiments described with respect to impact layer 110. Similarly, the bladder of the impact layer 120 can be designed so as to have similar performance properties as the foam embodiments described with respect to impact layer 120. These embodiments can also have pumps that circulate or refresh the air or fluid supply after an impact, or to maintain a desired pressure.

In some embodiments, the impact layer 110 and secondary impact layer 120 are attached to each other by an adhesive, hook and loop fastener, or other fastening means such as a strap or vinyl cover.

In some embodiments, the thickness of the foams of impact layer 110 and secondary impact layer 220 are the same, and in other embodiments they may be different.

In one particular embodiment of the current disclosure, the safety padding may be used as hockey padding. Such padding can include use as termination post padding, which is normally applied over the termination posts of any exposed outside corners of hockey glass. Outside exposed corners normally would occur, for example, where the glass above the dasher boards cuts away from the dasherboards to encase the player boxes or penalty boxes. These corners can be hazardous for any player who happens to contact such a corner at a high rate of speed.

Figure 2A:
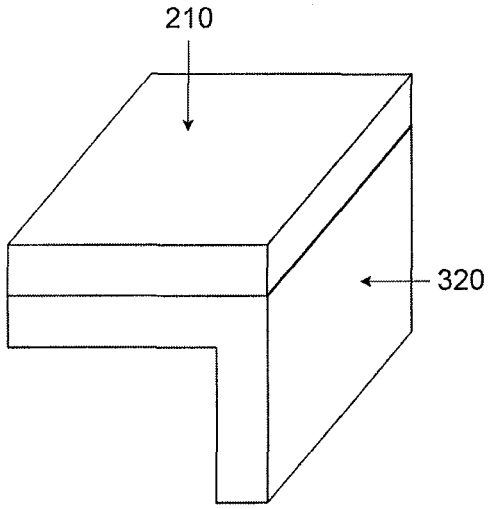
FIGS. 2A and 2B are perspective views of energy absorbing termination padding according to the present disclosure.
Figure 2B:
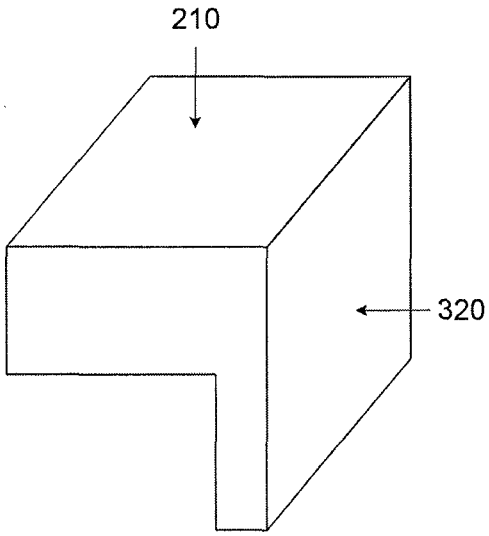

Turning now to FIGS. 2A and 2B, embodiments of the safety foam as used in an energy absorbing termination padding is disclosed. The energy absorbing termination padding can be of an L-shaped or corner-shaped design to accommodate the outer edge of a hockey glass termination. The energy absorbing termination padding includes two energy absorbing panels assembled in the L-shape with a first side, or open facing panel 210, and a second, ice facing panel 220. The panels may be substantially perpendicular to each other, or can be arranged at any angle necessary for a good fit with the termination corner.

The opening facing panel 210 can face the opening in the glass where the player's box typically is and generally would be the face where the greatest risk of impact is associated. As shown in FIGS. 2A and 2B, the opening face panel can be a safety foam as previously disclosed. In other embodiments, the open facing panel 210 can be one or more layers of closed cell foam such as extruded or expanded polystyrene, including foams formed from pre-expanded beads, polyethylene, expanded polyethylene, extruded polyethylene, polyisocyanurate, expanded polypropylene, expanded polyurethane or open cell foam such as polyurethane foam or visco-elastic polyurethane. Thus, the open facing panel 210 can be any type of foam, with one or more layers, and can be constructed of the safety foam previously described. Additionally, instead of foam, the opening facing panel 210 could be a gas or liquid bladder.

The ice facing panel 220, in one embodiment, can be made from closed cell foam such as extruded or expanded polystyrene, including foams formed from pre-expanded beads, polyethylene, expanded polyethylene, extruded polyethylene, polyisocyanurate, expanded polypropylene, expanded polyurethane, or open cell foam such as polyurethane foam or visco elastic polyurethane. In other embodiments, the ice facing panel 220 can be made of the safety foam previously disclosed. Thus, the ice facing panel 220 can be any type of foam, with one or more layers, and can be constructed of the safety foam previously described. Additionally, instead of foam, the ice facing panel could be a gas or liquid bladder. In some embodiments, the ice facing panel is not present.

FIG. 2B depicts the L-shaped foam panel formed of one type of foam. The open facing panel 210 and ice facing panel 220 of the foam are milled from the same block of foam, or made from a mold. Alternatively, the open facing panel 210 and the ice facing panel 220 of the foam may join at a miter or butt joints, and the foam may be of the same or of a different type. Other types of connections can be possible, such as lock miters, dovetails, finger joints, and any other type of connection. The thickness of the foam at the open facing panel may be relatively thicker or thinner than the ice facing panel. Generally, impacts received at the foam that are most dangerous occur at the open facing side and accordingly the foam of the open facing panel 210 may be relatively thicker.

Figure 3:
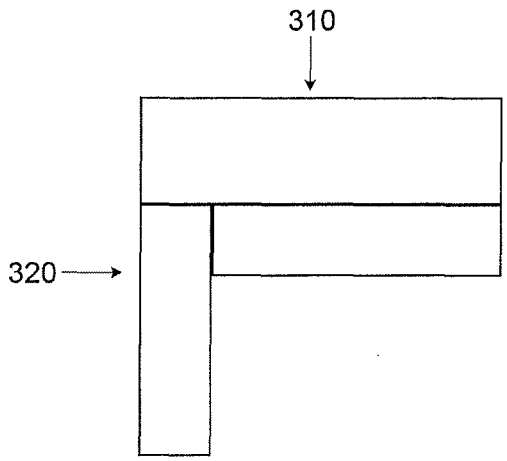
FIG. 3 is a perspective view of energy absorbing termination padding according to the present disclosure.

In one particular embodiment, shown in FIG. 3, the opening facing panel 310 is safety foam with an impact layer 1½ inches thick constructed of flexible polyurethane foam backed by a secondary impact layer of 1" thick expanded polyethylene beads with an ice facing panel 320 that is constructed of 1" thick expanded polyethylene beads. The improved termination padding as shown in FIG. 3 is 42 inches tall and 4 inches wide. In the particular embodiment illustrated in FIG. 3, the end face of the ice facing panel 320 forms part of the secondary impact layer of the open facing panel 310, however, in another embodiment, the secondary impact layer of the open facing panel could form part of the ice facing panel. In other embodiments the open facing panel and the ice facing panel could meet at a mitered corner, where each piece is angled at approximately 45 degrees or some other suitable angle to match the termination. Furthermore, in embodiments in which one or more of the panels have one or more layers, it is possible that each layer of one panel, meets a layer of the other panel in a different way. For example, if both the open facing panel and the ice facing panel are made of safety foam, the secondary impact layers could meet at a miter and the impact layers could meet with butt joints. Other types of connections can be possible, such as lock miters, dovetails, finger joints, and any other type of connection. In other embodiments, the end face of the ice facing panel 320 and the secondary impact layer of the open facing panel 310 could be milled from the same block of foam, or alternatively made from a mold.

In another embodiment, the opening facing panel 310 is safety foam with an impact layer 1½ inches thick constructed of flexible polyurethane foam with an indent force deflection rating at 25% of 63-77 lbs. as tested by ASTM D-3574-01, backed by a secondary impact layer of 1" thick polyurethane foam with an indent force deflection at 25% of 125-145 lbs. as tested by ASTM D-3574-01, with an ice facing panel 320 that is constructed of 1" thick polyurethane foam with an indent force deflection at 25% of 125-145 lbs as tested by ASTM D-3574-01.

Figure 4:
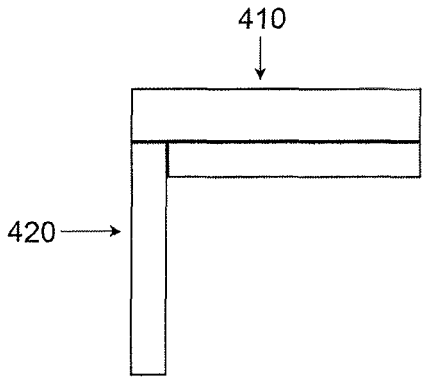
FIG. 4 is a perspective view of energy absorbing termination padding according to the present disclosure.

In another embodiment, shown in FIG. 4, the opening facing panel 410 is safety foam with an impact layer ¾ inches thick constructed of flexible polyurethane foam backed by a secondary impact layer of ½ inches thick expanded polyethylene beads with an ice facing panel 420 that is constructed of ½ inches thick expanded polyethylene beads. The improved termination padding as shown in FIG. 4 is 42 inches tall and 5 inches wide. Of course the height and width of the panels may be adjusted according to the size of the termination post and/or corner area of the rink to be protected by the energy absorbing termination padding.

In another embodiment, the opening facing panel 410 is safety foam with an impact layer ¾ inches thick constructed of flexible polyurethane foam with a indent force deflection rating at 25% of 63-77 lbs as tested by ASTM D-3574-01, backed by a secondary impact layer of ½ inches thick polyurethane foam with an indent force deflection at 25% of 125-145 lbs as tested by ASTM D-3574-01, with an ice facing panel 420 that is constructed of ½ inches thick polyurethane foam with an indent force deflection at 25% of 125-145 lbs as tested by ASTM D-3574-01.

Each panel may or may not be connected to the other panel. If the panels are connected to each other, they can be connected by adhesives, hook and loop fasteners, straps, tape, compression fittings, mechanical fasteners, screws, nails, staples, pins, tacks, or any other type of connection. Moreover, in embodiments in which one or more of the panels have one or more layers, it is possible that each layer of one panel can be fastened to a layer of the other panel in a different way, or not fastened at all to the corresponding layer of the other panel. In some embodiments, if both the open facing panel and the ice facing panel are made of safety foam, the secondary impact layers could be fastened together with adhesives, while the impact layer could be unfastened, or fastened with hook and loop fasteners.

It will be appreciated that the ice facing panel and the open facing panel can be of the same or different widths, lengths, and heights. For example, in some embodiments, the open facing panel can be wider, taller, and/or longer than the ice facing panel. In other embodiments, the ice facing panel can be wider, taller, and/or longer than the open facing panel. In still other embodiments, one facing panel might be bigger than the other facing panel in some dimensions, but smaller in others.

While the embodiments presented in FIGS. 3 and 4 were each 42 inches tall, other embodiments can be taller or shorter depending on the needs of the rink. This can depend on the height of the glass, the height of the dasher boards, and the usual height of the athletes. In some embodiments the height of the termination padding can be from the top of the dasher board all the way to the top of the glass. Some embodiments can be 4 feet, 5 feet or taller, such as 6 feet. Other embodiments can be 3 feet and shorter.

In another embodiment, the ice facing panel and the open facing panel can both be made of safety foam. In still another embodiment, the thicknesses of the safety foam and/or the constituent impact layer and secondary impact layer can be the same or different between the ice facing panel and the open facing panel. For example, in one embodiment, the ice facing panel can have safety foam where the impact layer is ¾" foam and the secondary impact layer is ½" foam and the open facing panel has thicker, 1½" impact foam with 1" secondary impact foam.

In another embodiment, the energy absorbing termination padding can include a cover. The cover can be made of vinyl, canvas, plastic, cotton, polytetrafluoroethylene (PTFE) i.e. "GoreTex"™ fabric, or any other suitably durable material. The cover can have screen printing or other graphics on it. In other embodiments, the cover can control the amount of air let into and out of the padding to control and/or change the compressibility of the foam by controlling the emissibility of air into, or out of the foam. Additionally, the cover can be made partly of vinyl or other plastic, and partly of a more air-permeable material such as mesh, cotton, or canvas in a controlled amount to precisely limit the amount of air that can enter or leave the cover to control the compressibility of the foam. Thus by controlling the amount of air permeable material, the compression properties of the foam can be adjusted. In some embodiments with a cover, the cover can be completely air sealed, thus increasing the compression resistance of the foam. In other embodiments the cover can be completely air permeable, thus decreasing the compression resistance. In some embodiments, the cover can help absorb impact and also present a softer surface for an athlete to contact, thus avoiding scrape injuries.

In some embodiments, the cover can be a material with increased friction to prevent the athlete from sliding off the padding during the collision. This can prevent the athlete from sliding from the protective padding onto other unprotected surfaces. This cover can also be soft to the touch and feel, or can be a soft-touch rubber composition.

Figure 5:
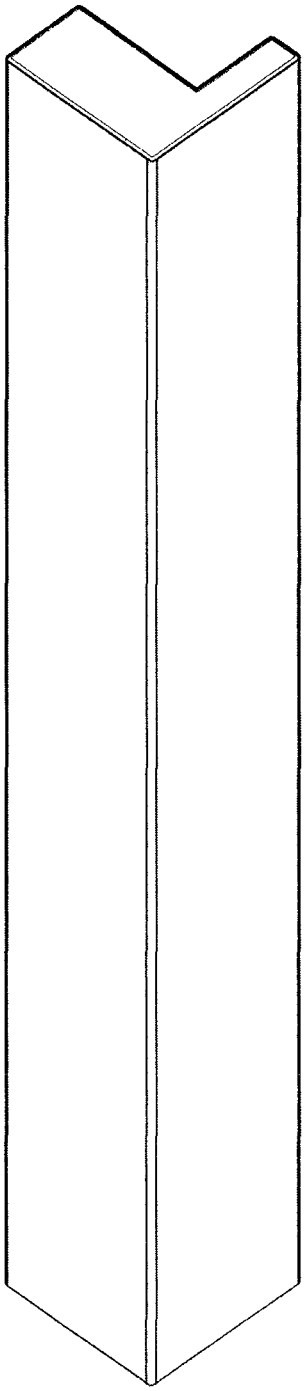
FIG. 5 is a perspective view of an energy absorbing termination padding with a cover according to the present disclosure.
Figure 6:
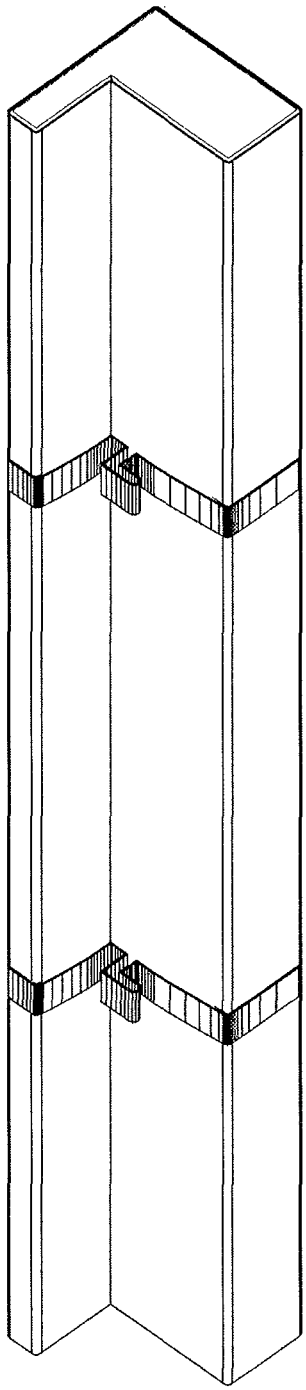
FIG. 6 is a perspective view of an energy absorbing termination padding with a cover according to the present disclosure.

FIGS. 5 and 6 show an embodiment of the current invention with a vinyl cover. It will be appreciated that the vinyl cover is constructed with an inner dimension corresponding to an outer dimension of the safety padding, which, for example, forms an L-shaped pad with the L-shaped foam and an L-shaped cover. The cover thus may be configured so that it does not substantially compress the foam contained therein. In still other embodiments, any safety padding in the corner post padding can be formed by a combination of two separate foam pads attached to the termination post separately and they may be covered as a unit, separately, or not covered at all. Each layer can be independently removable.

Figure 7:
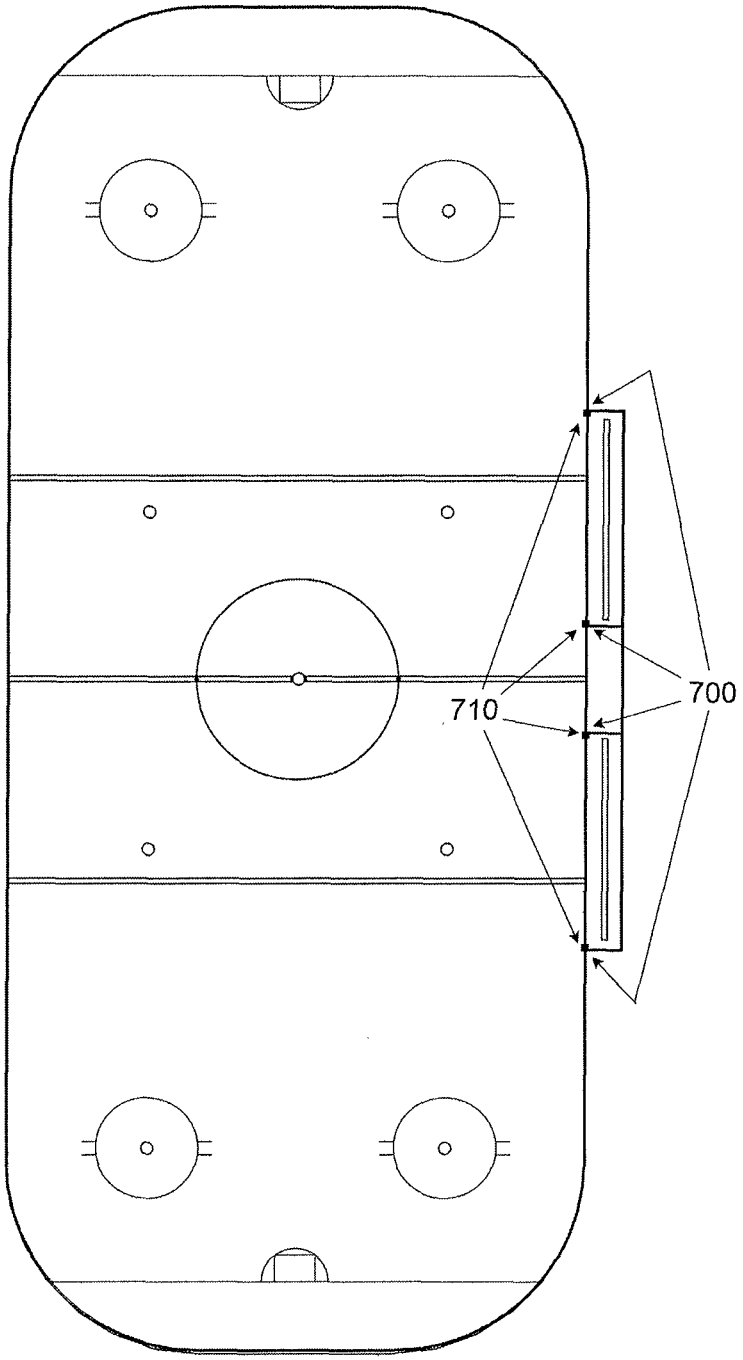
FIG. 7 is a perspective view of a hockey rink with an energy absorbing termination padding according to the present disclosure.

Referring now to FIG. 7, an energy absorbing termination padding 710 according to one embodiment of the current disclosure is shown attached to the termination of the glass 700.

Figure 8:
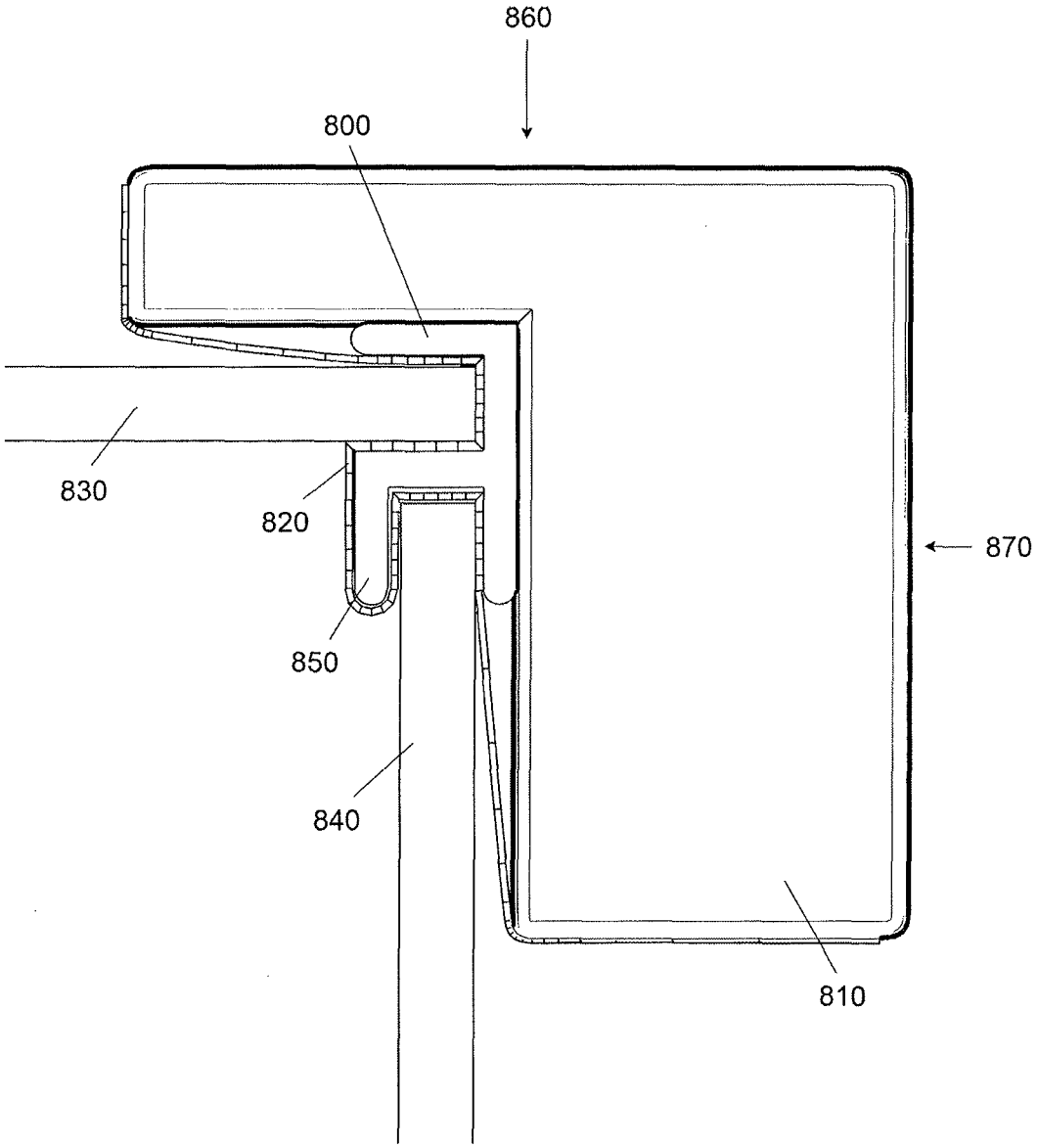
FIG. 8 is a perspective view of a termination post with glass and energy absorbing termination padding according to the present disclosure.
Figure 9:
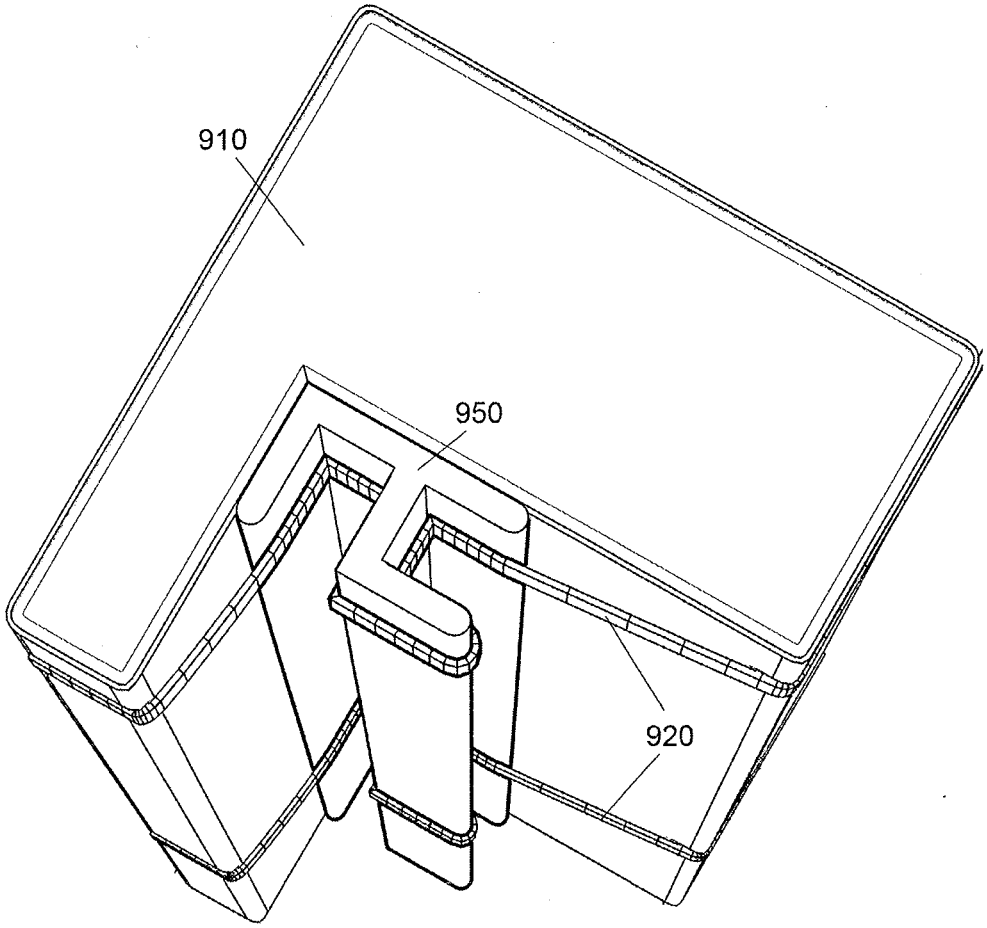
FIG. 9 is a perspective view of a termination post with glass and energy absorbing termination padding according to the present disclosure.
Figure 10:
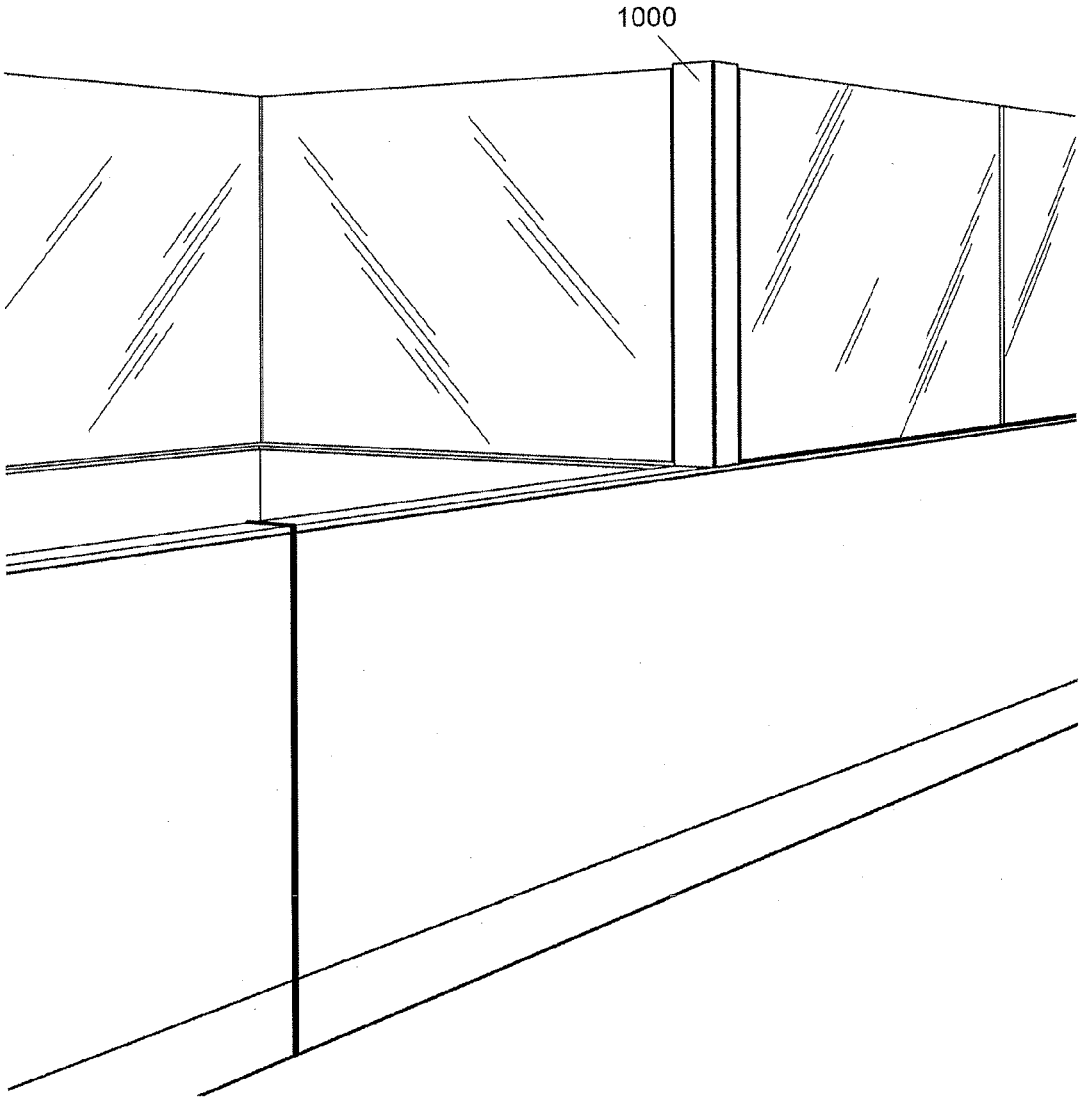
FIG. 10 is a perspective view of a termination post with energy absorbing termination padding according to the present disclosure.

FIG. 8 shows a close up of the termination 800. The energy absorbing termination padding 810 can be attached to the termination post 850 by one or more straps 820 on the outside of the energy absorbing termination padding. The straps 820 enable for adjustments to the tightness or looseness of the foam padding against the hockey glass. Once the straps are in place, the hockey glass 830, 840 is then put into position against the straps inside the termination post, locking the straps. The use of straps and a cover has the added benefit of allowing safety padding replacement without removal of the glass. In some embodiments, the length of the straps is adjustable, by means of hook and look fasteners, buckles, D-rings, or other means, allowing for easy adjustment of the tension of the pad. The open facing panel 870 faces the player box or other open area, and the ice facing panel 860 faces the ice side, or where the sporting event is normally taking place. FIG. 9 is a similar perspective view as FIG. 8, but shows one embodiment of the energy absorbing termination padding 910 attached by straps 920 to the termination post 950, but without the glass 830 and 840 installed. Once the strap is in place, hockey glass can then be slid into each channel of the termination post 950 tightening and locking the padding into place. Similar to FIG. 8, the open facing panel 970 faces the players box or other open area, and the ice facing panel 960 faces the ice side, or where the sporting event is normally taking place. FIG. 10 shows a perspective view of what the termination pad 1000 mounted on a termination of the glass in a hockey arena can look like.

One advantage the L-shaped structure of the energy absorbing termination padding, combined with the strap attachment mechanism is that the energy absorbing termination padding fits properly over the surface it covers with little or no deformation or compression of the foam padding. This is in contrast to the traditional foam padding that is simply "wrapped" around the corner edge, thus pre-compressing it and reducing its effectiveness.

In other embodiments, the straps or pad connectors could automatically release upon experiencing certain types of forces that would likely break fixed connectors. These "break away" straps can allow for additional force dispersing capabilities and also increase the expected life of the improved energy absorbing termination padding by preventing strap failure if the padding were to be hit in a manner as to put strain on the straps.

In some embodiments, the straps could be designed so as to allow the energy absorbing termination padding to slide in several directions to allow for a certain amount of "play," in the attachment. This can allow the energy absorbing termination padding to "slide" with an athlete if the athlete contacts the padding at an angle, thus preventing the athlete from sliding off the protected padding and onto an unprotected area. Additionally, this play can prevent the straps from prematurely breaking in a manner similar to that of the breakaway straps. In some embodiments, the padding may be attached rigidly with little or no play. In other embodiments, the straps can have buckles, or D-rings.

Additionally, in other embodiments, the padding may be attached by slipping an open end of the vinyl cover over the termination post similarly to the way the traditional padding is attached. In other embodiments, the padding may be attached by hook and loop fasteners, adhesives, brackets, metal brackets, screws, nails, rivets, tacks, welding, melting, tapes, and other fastening means as would be appreciated by a person of ordinary skill in the art.

Additionally, not all termination corners are an exact right angle. Some may be several degrees off due to improper installation, or have warped over time or after collisions. This condition may lead to sloppy fit. In one embodiment, another foam layer is inserted between the padding and the termination corner to adapt the foam to the precise dimensions of the corner. This foam layer can be a standard sheet of foam that is placed in any gaps that result from an improper fit, or can be pre-cut so as to perfectly adapt the pad to the corner.

Additionally, to further "fit" the padding to a corner, the two panels may be connected by a hinge. This hinge may be constructed of a flexible plastic such as polypropylene. The hinge can be a single flexible sheet of plastic that runs the entire vertical height of the padding, or can be one or more strips of the plastic placed at selected points. The plastic can be inserted in any layer of the padding. Additional embodiments feature connections between the two panels that are not substantially 90 degrees, such as 45, 23, 17, 100, 120, and other angles.

Alternatively, in some embodiments, the panels are not connected at all, or are loosely connected so that they can match any angle necessary.

Figure 11A:
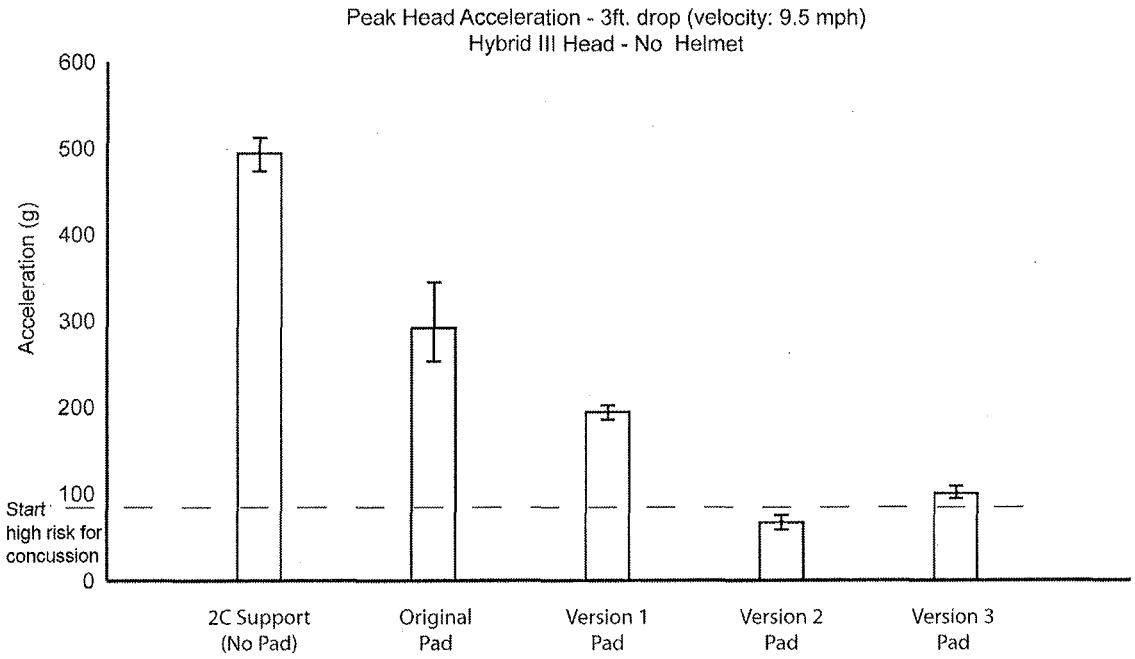
FIG. 11A is a chart showing test results for various embodiments of the current disclosure compared to traditional foam padding.

The effectiveness of various embodiments of the energy absorbing termination padding as compared with the traditional foam padding is shown in FIG. 11A. FIG. 11A shows results of an independent laboratory test which compares the impact force of a head without a helmet at 9.5 mph into an unpadded termination post ("2C Support No Pad") used to mount the glass, a traditional termination corner thin foam pad ("original pad") wrapped in vinyl, and three embodiments of the current disclosure with varying impact and secondary impact layer thicknesses, both also wrapped in comparable vinyl. As can be seen from FIG. 11A, the impact against an unpadded termination post results in 475 (+/−5) g of force—well above the threshold for concussion which is around 90-100 g. The traditional termination corner thin foam padding clad in vinyl reduces the force to just under 282 (+/−33) g of force, but notably, still well above the risk acceleration resulting in concussion. The embodiments of the present disclosure dramatically reduced the force, and in the case of version 2, this force came in well under the concussion risk at 62 (+/−10) g of force. The testing was conducted by Jeff Wheeler, M.S. of VectorScientific of California on behalf of Applicant. The test results clearly show the safety advantage of the safety padding over the standard foam and over the unprotected bare termination post. The traditional termination corner pad is a vinyl sleeve open at the top and bottom with a foam core and is sold by Athletica™ under the brand name Crystaplex™.

Figure 11B:
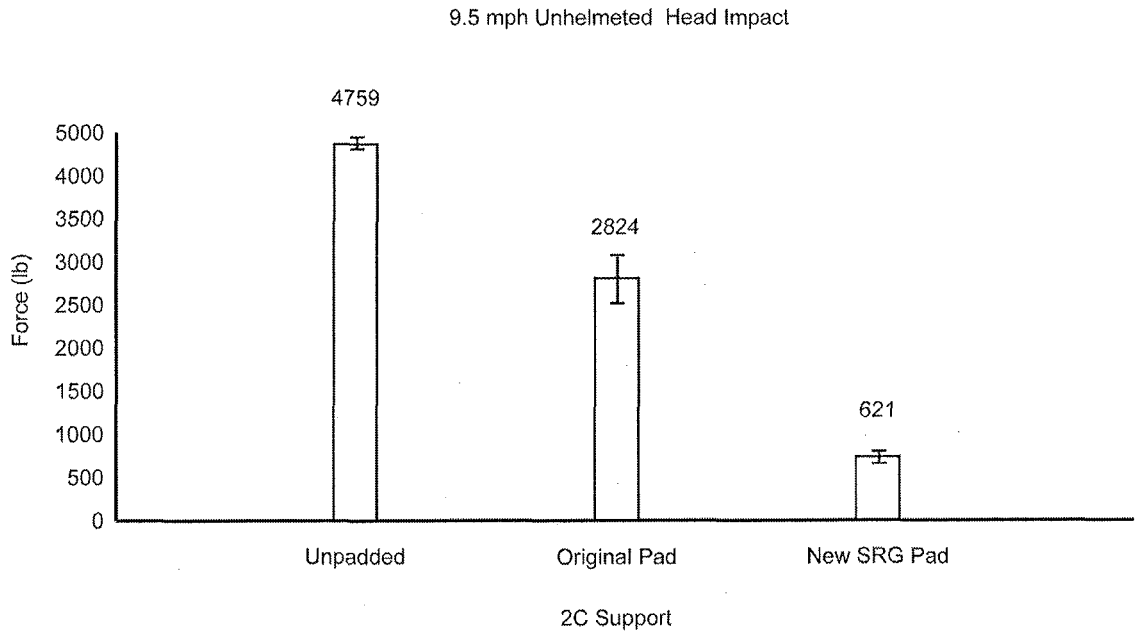
FIG. 11B is another chart showing impact test results for another embodiment of the present disclosure compared to traditional foam and no foam padding.
Figure 11C:
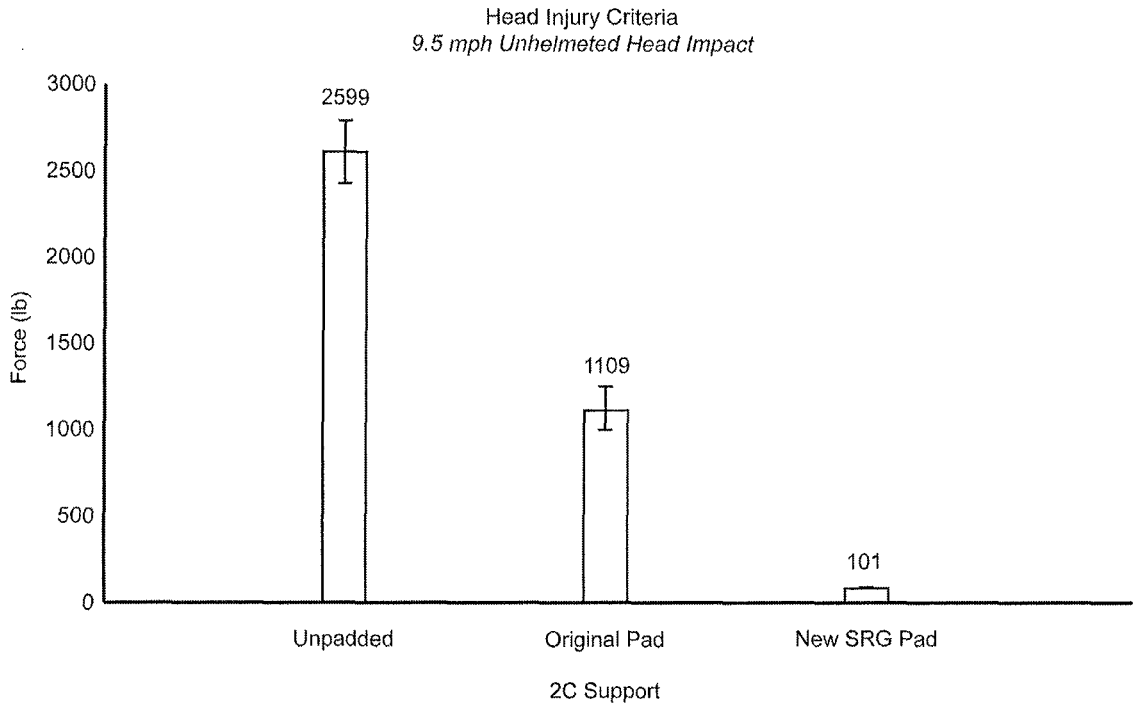
FIG. 11C is a chart showing the head injury criteria for unhelmeted head impacts for the another embodiment of the present disclosure compared to traditional foam and no foam padding.
Figure 11D:
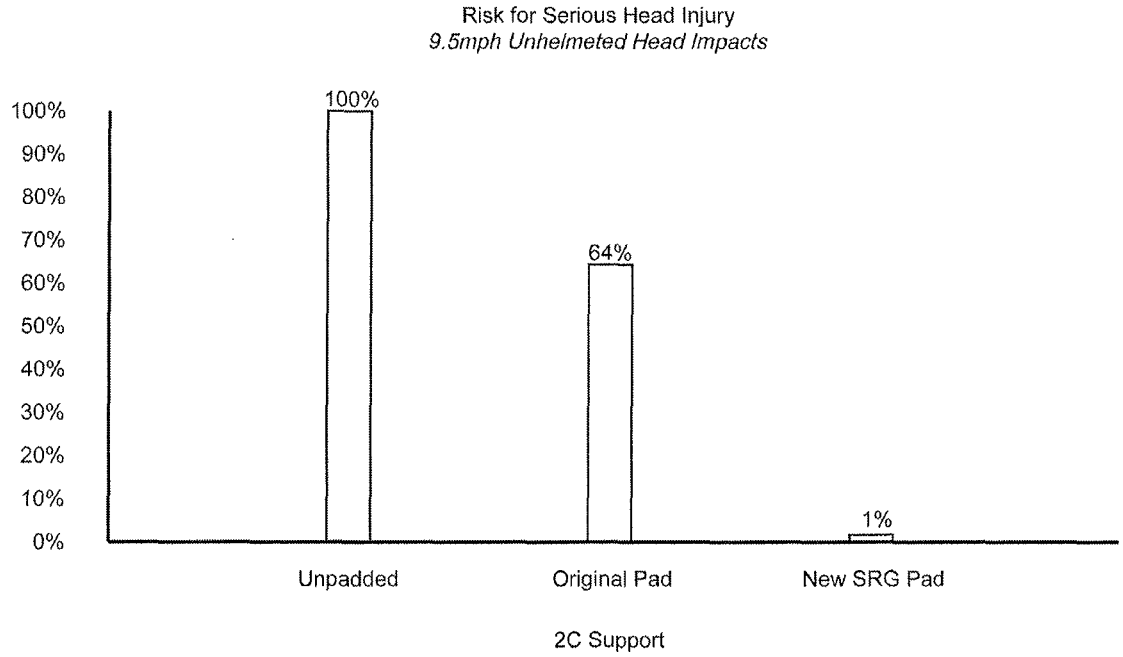
FIG. 11D is a chart showing the percentage of risk of serious head injury for the another embodiment of the present disclosure compared to traditional foam and no foam padding.

FIG. 11B shows results of another independent laboratory test which compares the impact force of a head without a helmet at 9.5 mph into an unpadded termination post ("Unpadded") used to mount the glass, a traditional termination corner thin foam pad ("original pad") wrapped in vinyl, and an embodiment of the current disclosure with an impact layer of a closed cell foam, also wrapped in comparable vinyl. The test results show the impact force of an unhelmeted head at an unpadded termination post is 4759 lbs., an original pad is 2824 lbs., and the pad of the current disclosure is 621 lbs. Based on data for the 9.5 mph head impact measurements (FIG. 11B) and the impact level at which serious head injury may be caused (FIG. 11C), this embodiment dramatically reduced the force and came in well under the concussion risk. At 621 lbs of force (FIG. 11B), the present embodiment reduces the risk of serious head injury due to acceleration down to 1% (FIG. 11D). In contrast, the force of 4759 lbs. from an unpadded termination post results in a 100% chance of serious head injury (FIG. 11D), and the force of 2824 lbs. from an original pad results in a 64% chance of serious head injury (FIG. 11D). The testing was conducted by Jeff Wheeler, M.S. of VectorScientific of California on behalf of Applicant.

In use, according to one embodiment, the L-shaped pad is placed in front of the termination post with the ice facing side facing the ice rink, and the open facing side facing the player's box or penalty box. The straps are then connected behind the termination post, and finally, the hockey glass on both sides of the corners are placed into the termination post. The straps are pushed into the channels in the termination posts that receive the glass by inserting the glass. (See FIGS. 8 and 9). Other embodiments might feature straps that are elastic and stretch over the termination posts. Finally, still other embodiments would feature an open ended cover which would slide over the termination post, and, similar to the straps, would be pushed into the channels on the termination posts.

Figure 12:
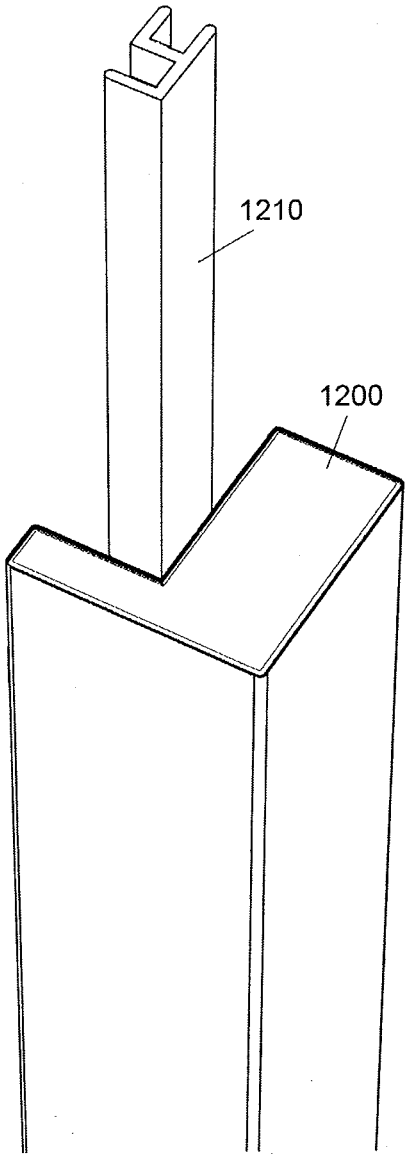
FIG. 12 is a perspective view of a termination post with energy absorbing termination padding according to one embodiment of the present disclosure.
Figure 13:
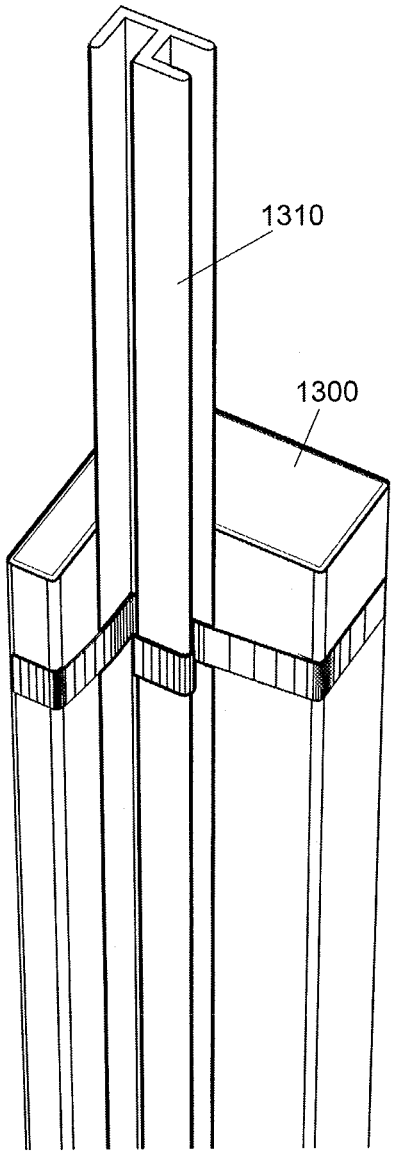
FIG. 13 is a perspective view of a termination post with energy absorbing termination padding according to one embodiment of the present disclosure.

During play, because of the increased protection of the termination pad an athlete is protected from injury by contact with the termination post both from the ice side, or from the open side. FIG. 12 in particular is a close up view of the improved shock absorbing termination padding 1200 according to one embodiment and how it protects an athlete from the metal termination post 1210. FIG. 13 shows a view of the termination padding 1300 according to one embodiment and the termination post 1310 from the reverse angle as FIG. 12.

Turning to FIGS. 14A-14E, an energy absorbing termination padding 1400 is disclosed. The energy absorbing termination padding 1400 may be configured with a u-shape design to accommodate the outer edge of a hockey glass termination. The energy absorbing termination padding 1400 may be constructed one or more impact layers (see e.g., impact layer 110 and secondary impact layer 120 shown and described above) and may be arranged within an outer cover configured with a u-shaped design. For example, the energy absorbing termination padding 1400 may include two open facing panels 1410, 1420 and an ice facing panel 1430, and the panels may be may be constructed with one or more impact layers. The open facing panels 1410 and 1420 may be substantially parallel to each other, and the ice facing panel 1430 may be substantially perpendicular to the open facing panels 1410, 1420. In some implementations, the panels may be arranged at any angle necessary for fitting with the termination corner.

The energy absorbing termination padding 1400 may include an outer cover 1435, which may be constructed of a durable, flexible material such as coated nylon and may have the same or a similar shape to the u-shaped configuration of the impact layers in an uncompressed state. For example, the outer cover 1435 may be configured with a design that accommodates the u-shaped design of the assembled open facing panels 1410, 1420 and the ice facing panel 1430. When the outer cover 1435 is joined to the termination corner, described below, the outer cover may hold the impact layers forming the open and ice facing panels in place without compressing the foam, and therefore without altering the compressibility of the foam.

Figure 14A:
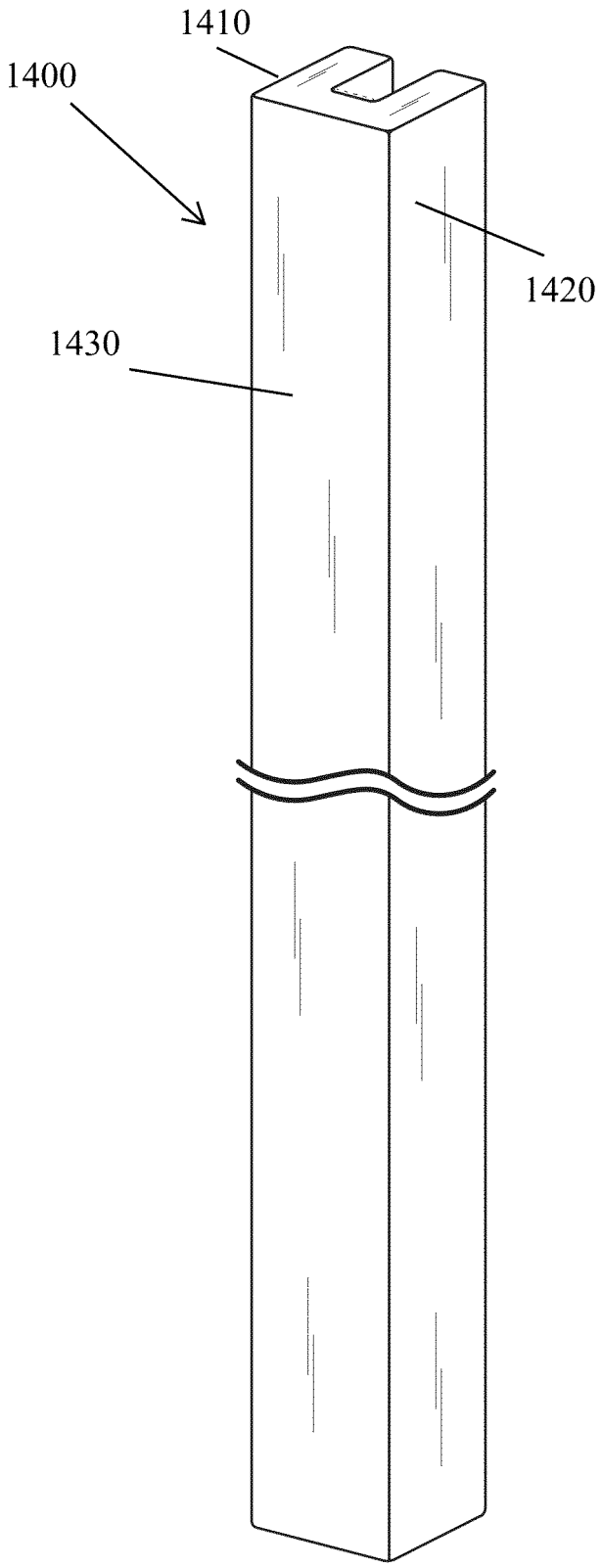
FIGS. 14A-14E are perspective, front, back, side and top views of an energy absorbing termination padding according to another embodiment.
Figures 14B, 14C:
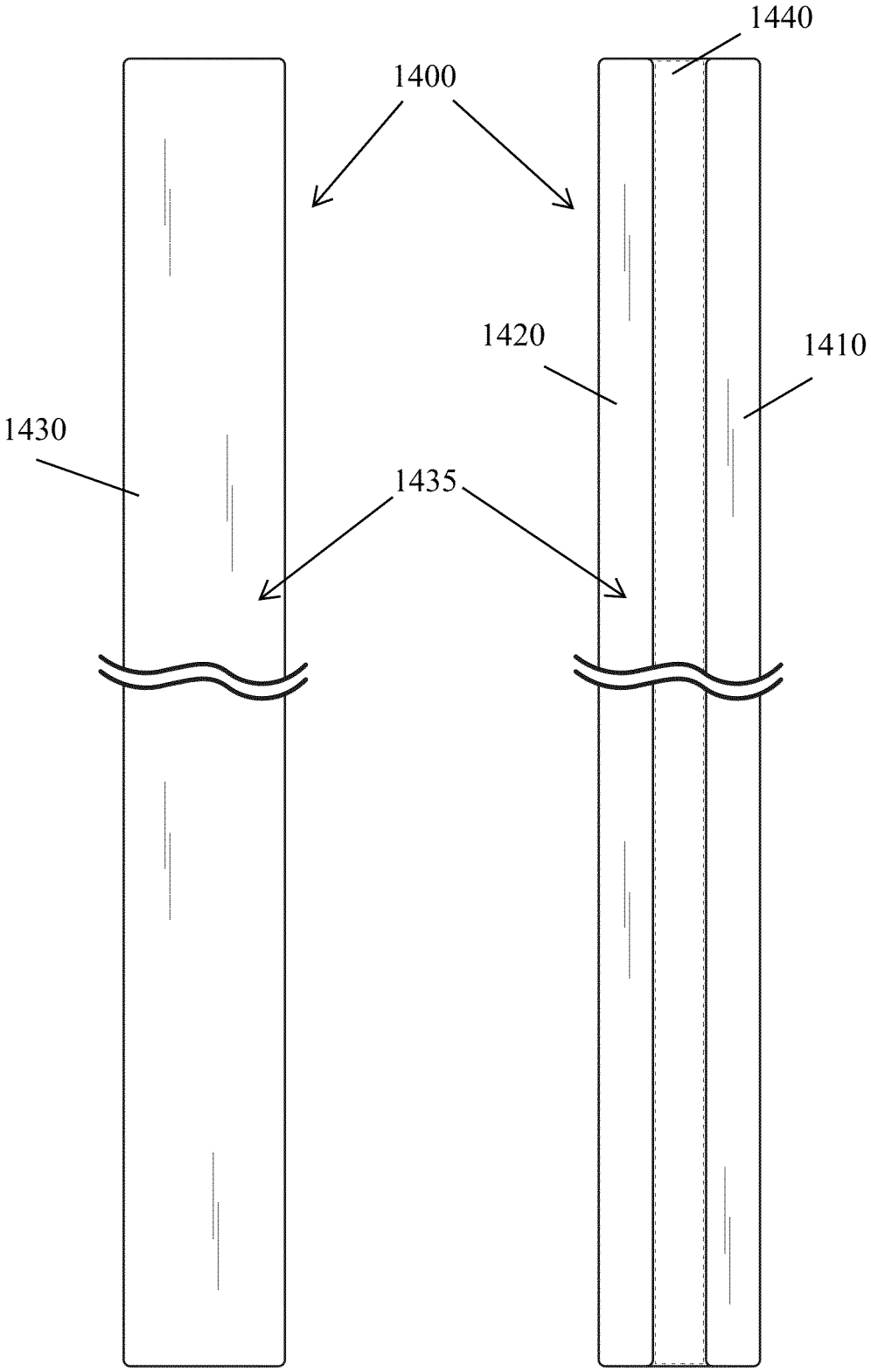
Figure 14D:
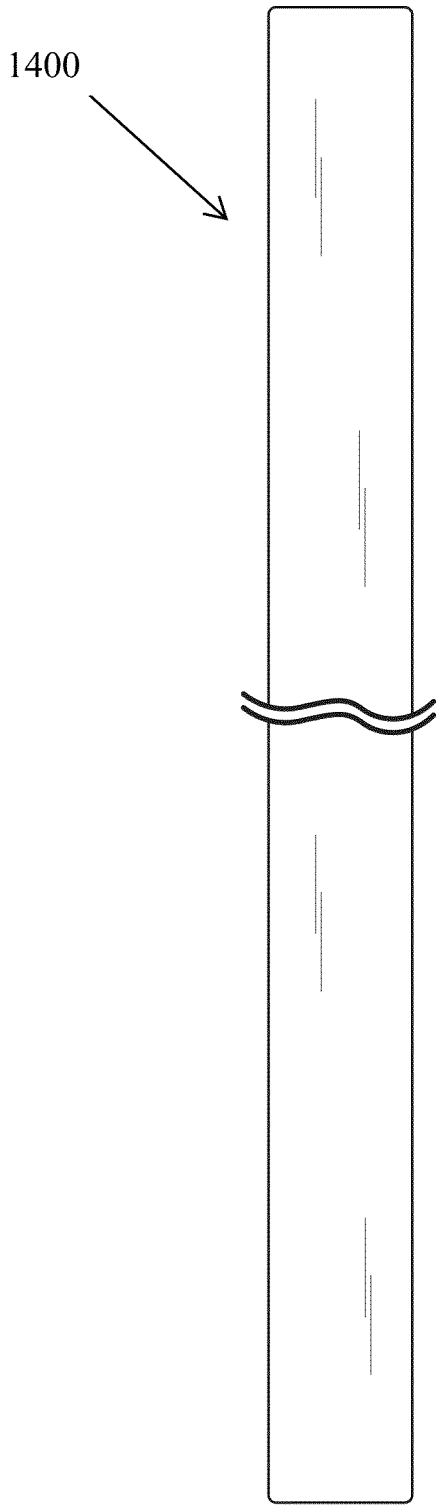
Figure 14E:
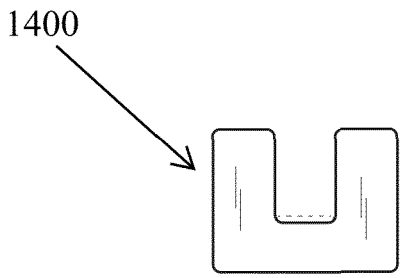

In some implementations, an attachment component 1440 such as hook and loop fasteners may be joined to the energy absorbing termination padding 1400 along the outer portion of the cover for allowing the energy absorbing termination padding 1400 to releasably attach to a termination corner having a complementary attachment component joined thereto. For example, the attachment component 1440 may be provided as one side of a hook and loop fastener (e.g., the loop side) while the termination corner includes the other side of the hook and loop fastener (e.g., the hook side). The attachment component 1440 may be joined to the energy absorbing termination padding 1400 on an internal surface of the u-shaped padding. In FIGS. 14C and 14E, the attachment component 1440 area corresponding to the bottom of the internal u-shape of the padding. The attachment component may additionally or alternatively be joined to one or both of the sides of the internal u-shape of the padding, and the termination corner may include an attachment component on one or more sides facing the padding where the attachment component is arranged. The padding may additionally or alternatively be attached to the termination post or glass by straps, adhesives, brackets, metal brackets, screws, nails, rivets, tacks, welding, melting, tapes, and other fastening means as would be appreciated by a person of ordinary skill in the art.

Figure 15:
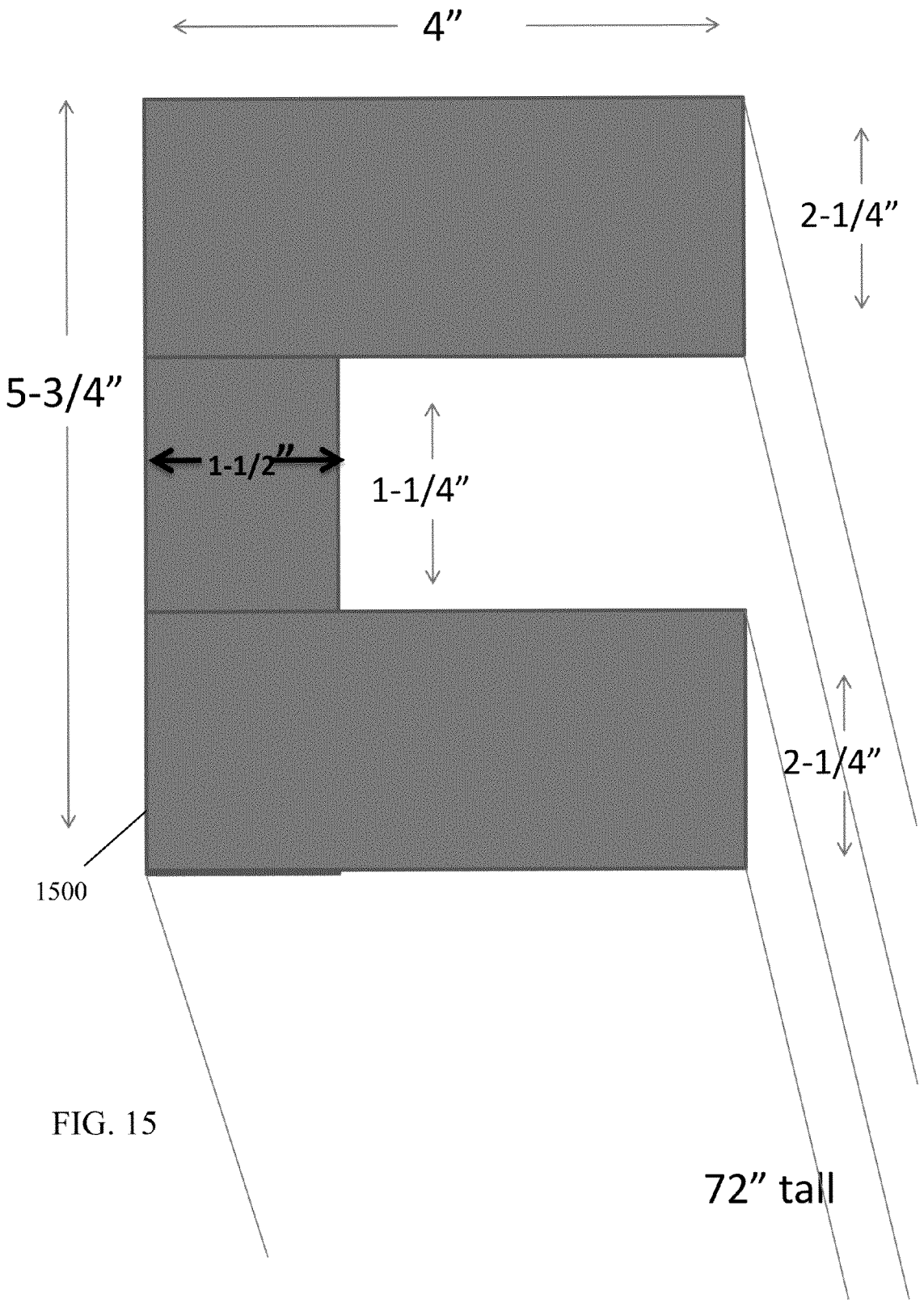
FIG. 15 is a cross-sectional view of energy absorbing foam that may be used for the termination padding.

FIG. 15 is a cross-sectional view of an implementation the safety padding 1500 with the open facing panels and the ice facing panel in an assembled state. The safety padding 1500 may be positioned within the outer cover 1435 of the energy absorbing termination padding 1400 of FIGS. 14A-14E. The padding 1500 may be generally arranged within the interior of the deformable outer cover and is in an uncompressed state in the arrangement shown in FIG. 15. The foam of the u-shaped padding may include dimensions that provide the foam assembly with a u-shape and is not limited to the dimensions shown in FIG. 15. For example, the foam configured into a u-shape may have a variable width, height and length. However, in some implementations, the length of the foam may be configured to fit within an outer cover having a length of about 48 in., about 60 in., or about 72 in.

The safety padding may include one or more layers of safety foam described above at least in connection with FIG. 1. Where multiple layers are used, the foam may be joined in the manner described above at least in connection with FIGS. 2A-2B. For example, the foam layers may join at a miter or butt joints, and the foam may be of the same or of a different type. Other types of connections can be possible, such as lock miters, dovetails, finger joints, and any other type of connection that enables the foam to be joined to form the open and ice facing panels of the of the energy absorbing termination padding 1400. For example, an outer layer (e.g., a first impact layer) of the padding may be formed of one type of foam and an inner layer (e.g., a second impact layer) of the padding may be formed of another type of foam. The different foam types between the inner and the outer layer may be adhered to one another by an adhesive described above at least in connection with FIG. 1, and the abutting ends of the foam panels may be joined by one or more of the aforementioned connections described above at least in connection with FIGS. 2A-2B.

In use, the u-shaped safety padding may be placed over the front and sides of the termination post. The ice facing panel of the u-shaped pad may be placed over the front ice facing side of the termination post, and the open facing sides of the safety padding may be placed over the open facing sides of the termination post facing of the player's boxes or penalty boxes, thereby providing protection to the ice facing and open facing sides of the termination post. An attachment means, such as one side of a hook and loop fastener may join to an opposing face of the termination post with the other side of the hook and loop fastener positioned thereon. Attachment means having other configurations may be used as discussed above.

Because the energy absorbing termination padding 1400 may include safety padding described above in connection with FIGS. 1-10 and 15, the safety padding may absorb impact forces consistent with the testing data provided above in connection with FIGS. 11A-11D.

Additional embodiments of the current invention include use of the safety foam as a cap rail of a hockey rink. The cap rail is the horizontal portion on the top of the dasherboard where the glass is attached. As the glass is slightly offset from the ice edge of the dasherboard there is a small horizontal surface that may be impacted during play. Use of the safety foam as a cap rail can reduce the risk of injury.

In another embodiment, the safety foam can be used to protect athletes from the stands used to hold up a basketball hoop, and/or padding on the scoring table. Other embodiments include uses to protect athletes from the goal post in football, or any other place where an athlete could come into contact with an environmental hazard.

Uses of the present invention are not limited to protection of athletes from stationary objects and hazards on the playing surface but can be used in padding worn by players such as helmets, shoulder pads, knee, thigh, hip, rib, shin, or neck padding for football, soccer, baseball (including chest protectors for umpires and catchers), and other uses where padding is employed in sports.

Although the various embodiments of the present disclosure have been described with reference to preferred embodiments, persons skilled in the art will recognize that changes may be made in form and detail without departing from the spirit and scope of the present disclosure.

I claim:

1. An energy absorbing termination padding for a termination post in hockey rinks, comprising:

a first compressible foam panel joined to a second compressible foam panel, the foam panels adapted to absorb impact forces and are arranged perpendicular relative to one another to form a corner or an L-shaped panel;

a cover configured to receive the corner or L-shaped panel; and attachment means for attaching the cover to a hockey rink termination post, wherein the attachment means comprises one or more straps coupled to the outside of the cover, and wherein the one or more straps are adapted to conform to termination post cavities and one or more glass panels received therein wherein the one or more straps are configured to lock into place when the termination post cavities receive the one or more glass panels.

2. The padding of claim 1, wherein one of the first or second compressible foam panels defines an open facing panel and the other defines an ice facing panel, wherein the compressible foam of each of the ice facing panel and of the open facing panel comprises one or more of a closed cell foam or an open cell foam.

3. The padding of claim 2, wherein the open facing panel is formed of the open cell foam, the open cell foam comprising one or more of a polyurethane foam or a visco-elastic polyurethane foam.

4. The padding of claim 2, wherein the ice facing panel is formed of the open cell foam, the open cell foam comprising one or more of a polyurethane foam or a visco-elastic polyurethane foam.

5. The padding of claim 2, wherein the open facing panel and the ice facing panel are formed of the open cell foam, the open cell foam comprising one or more of a polyurethane foam or a visco-elastic polyurethane foam.

6. The padding of claim 1, wherein the cover is configured to hold the foam of the corner or L-shaped panel in an uncompressed state.

7. The padding of claim 1, wherein a thickness of the first compressible foam panel is greater than a thickness of the second compressible foam panel.

8. The padding of claim 1, wherein the attachment means comprises one of hook and loop fasteners for coupling with the other of the hook and loop fasteners coupled to the termination post.

9. The padding of claim 1, wherein the attachment means is configured to couple the cover to the termination post with substantially little deformation or compression of the first compressible foam panel and the second compressible foam panel.

10. The padding of claim 1, wherein the attachment means further comprises a hook and loop fastener extending along a portion of the padding, the hook and loop fastener adapted to engage a termination post surface holding a complementary hook and loop fastener.

11. The padding of claim 1, wherein the one or more straps are configured to automatically release upon receiving a force having a substantial likelihood of breaking fixed connectors.

12. The padding of claim 1, wherein the one or more straps are configured to slide in a plurality of directions.

* * * * *